United States Patent [19]

Acker

[11] Patent Number: 5,069,568

[45] Date of Patent: Dec. 3, 1991

[54] LOOSELEAF BINDER HAVING A REMOVABLE PROTECTIVE ENVELOPE AND METHOD OF MAKING SAME

[75] Inventor: Fred Acker, Cordova, Tenn.

[73] Assignee: Kleer-Vu Plastics Corporation, Brownsville, Tenn.

[21] Appl. No.: 559,626

[22] Filed: Jul. 30, 1990

[51] Int. Cl.[5] ..... B42F 13/00

[52] U.S. Cl. ..... 402/73; 281/29; 206/424; 206/497

[58] Field of Search ..... 402/73, 75; 281/29; 206/424, 605, 610, 497

[56] References Cited

U.S. PATENT DOCUMENTS

| | | | |
|---|---|---|---|
| 3,215,450 | 11/1965 | Peterson et al. | 281/29 |
| 3,270,749 | 9/1966 | O'Connell | 402/75 X |
| 3,318,618 | 5/1967 | Mullen et al. | 281/29 |
| 4,582,442 | 4/1986 | Rager | 402/75 |
| 4,583,877 | 4/1986 | Wilson | 402/75 |
| 4,722,628 | 2/1988 | Rager | 402/75 |

*Primary Examiner*—Timothy V. Eley
*Assistant Examiner*—Willmon Fridie, Jr.
*Attorney, Agent, or Firm*—Wood, Herron & Evans

[57] ABSTRACT

A looseleaf binder having a protective envelope that encases the front and rear flaps and spine of the binder such that the binder can be opened to view the interior of binder while protecting the binder cover from dust and other substances. The protective envelope is wrapped around the binder prior to attaching a ring binder unit to the cover, and joined to itself along the periphery of the binder. The ring binder unit is then attached to the interior of the spine through the envelope so the front and rear flaps foldably enclose the ring binder unit. The protective envelope may be removed from the binder without damaging or blemishing the binder.

13 Claims, 1 Drawing Sheet

LOOSELEAF BINDER HAVING A REMOVABLE PROTECTIVE ENVELOPE AND METHOD OF MAKING SAME

FIELD OF THE INVENTION

The present invention relates to looseleaf binders and, more particularly, to binders having removable transparent coverings.

BACKGROUND OF THE DISCLOSURE

Notebooks and other looseleaf binders typically comprise front and rear covers joined to a spine between them, with a ring binder unit attached to the interior of the spine so the front and rear covers foldably enclose the binder unit to protect the pages received on the rings of the binder unit. The display of looseleaf binders for purchase by the consuming public has presented problems in maintaining the original "new" appearance of the binders. The consumer wants to be able to open the binder to see the pages, ascertain the approximate number of pages, and test the ease of opening and closing the ring binder unit. When looseleaf binders are displayed without any protective covering, their covers can be discolored by fingerprints and other substances, prior to sale.

In an attempt to make looseleaf binders more durable for display, plastic coverings replaced cloth coverings to protect the front and back cover backing material since these plastic coverings can be cleaned with household detergents. While these materials are more tolerant of discoloration, the coverings could still be marked with pen inks that resist removal. Once so marked, the blemish remains since the cover cannot be removed without destroying the usefulness of the binder. Coverings that overwrap the entire closed binder have been tried, but they do not permit the binder to be opened or the ring binder unit to be tested without removing the entire covering.

Accordingly, there is a need for a protective cover that encases the interior and exterior of a looseleaf binder cover to prevent the discoloration of the underlying covering, yet which does not interfere with the opening and closing of the binder so the binder interior is accessible for inspection. While the customer may leave the cover intact to protect the binder from children handling it, the covering should be easily removable after purchase if the buyer desires to expose the clean binder cover.

SUMMARY OF THE INVENTION

The present invention provides a transparent protective envelope for the front and back covers and spine of a looseleaf binder cover. The envelope is transparent and completely encases the interior and exterior sides of the binder cover. Thus, dirt and oils remain on the outside of the envelope and do not reach the notebook cover underneath. Since the envelope is immediately adjacent the interior and exterior sides of the binder cover, it does not interfere with the opening and closing of the looseleaf binder. Furthermore, the envelope is removable without disfiguring the underlying cover in any way. By using this protective envelope, the buying public can view the binder cover without discoloring it and can remove the envelope without harming the binder cover after purchase.

In the preferred practice of the invention, a transparent, flexible film envelope or covering is placed around the front and back covers and spine of a binder before the ring binder unit is attached. The envelope is sealed to itself along a portion of the periphery of the binder cover, i.e., along the bottom edge and up the two sides. A ring binder unit is then attached to the inside of the spine, being connected through the cover as by the riveting of the unit to the spine. The protective envelope is not damaged by attaching the ring binder nor is the protective function and removability of the envelope affected by the later addition of the ring binder unit. The covering can be removed by pulling it away.

DESCRIPTION OF THE PREFERRED EMBODIMENT

Figure 1:
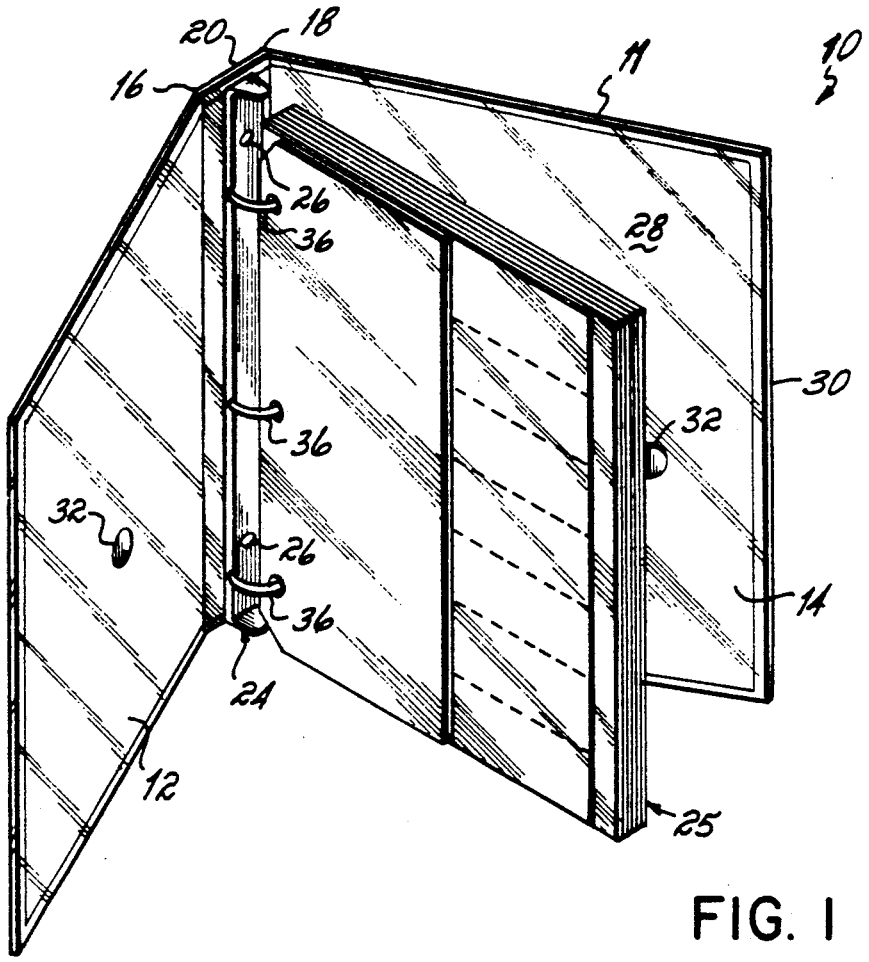
FIG. 1 is a perspective view of a looseleaf binder encased in the protective envelope of the present invention with the binder in the open position.

As shown in FIG. 1, a binder or notebook 10 has a cover 11 that includes a front flap 12 and rear flap 14 that are joined along edges 16 and 18 to a spine 20. A ring binder unit 24 is attached to spine 20 by means of rivets 26 or the like. Pages 25 may be inserted within notebook 10 by opening ring binder 24 and inserting rings 36 through pages 25 and shutting binder 24. Apart from the envelope to be described, the construction of the cover and binder may be of known type.

Encasing notebook cover 11 of FIG. 1 is an envelope 28. This envelope covers the exterior and interior of the front and rear flaps 12, 14 and spine 20 of notebook cover 11. The envelope is transparent so the covers are visible through it. The envelope passes between the ring binder unit 24 and the spine 20; it does not extend over the binder rings or impede their operation. Envelope 28 is a film material which is sealed to itself along periphery 30 of notebook cover 11, and preferably is not adhered to the notebook cover. While envelope 28 facially overlies the interior and exterior surfaces of notebook cover 11, it can be torn to remove it from cover 11 without damage to the cover. In the preferred embodiment of the present invention, one or more holes or perforations 32 are provided in envelope 28 to facilitate its removal. An instrument or fingernail can be inserted within one of the holes to tear envelope 28 so that it can be stripped off. The number, position and size of the holes are not important; a tear along any one surface of the envelope can be used for the removal of the entire envelope.

Figure 2:
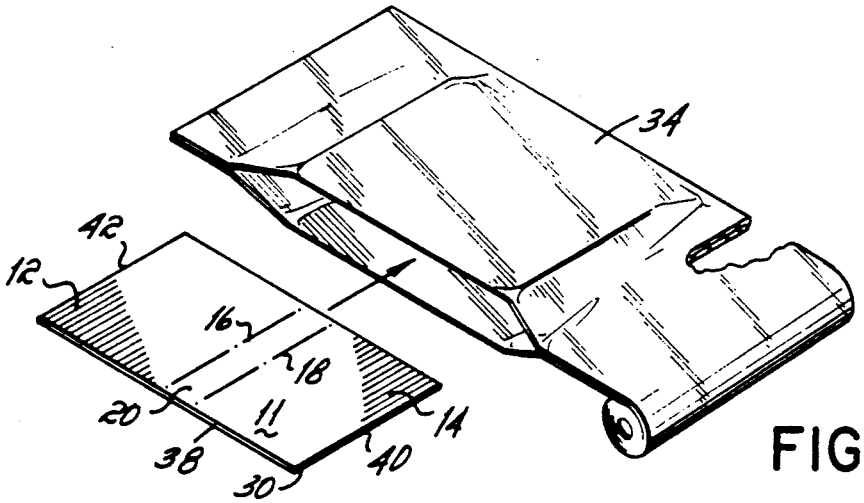
FIG. 2 is a view of the binder cover being inserted within the envelope-forming sheet material.

FIG. 2 shows how the envelope is applied to the cover. Sheet material 34 which may be used to form envelope 28 about binder cover 11 is provided in roll form. The preferred material is Reynocon 3023 Plastic Film and is commercially available from Reynolds Metal Company in Richmond, Va., but other materials are also suitable. The material comes off the roll longitudinally folded in half into which binder cover 11 is inserted as shown. The folded sheet is preferably sealed about cover 11 by a so-called L-seal machine of known type, although adhesives, pressure or other known sealing means, may be used to adhere the edges of sheet 34 to one another. L-seal machines are so called since they seal the material along edges 38 and 40 of cover 11 to form an "L". The seal along edge 40 of the previous cover provides a seal along edge 42 of cover 11 when material 34 is advanced for placement within the L-seal machine. The L-seal machine also cuts sheet 34 along the seal between adjacent covers in such a manner as to preserve the seal along those edges.

Figure 3:
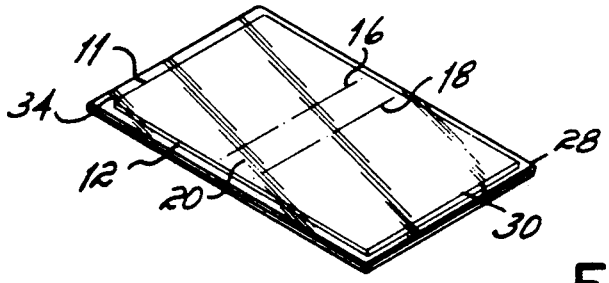
FIG. 3 shows the envelope material L-sealed about the cover prior to heat shrinking.

The separate, loosely encased cover 11 shown in FIG. 3 is preferably transported by conveyor belt through a conventional heat shrink tunnel machine. The heat applied to envelope 28 in the heat shrink tunnel shrinks envelope 28 tightly about cover 11. The previously identified preferred material has a heat shrink ratio of approximately 20%–30%, though other materials having different heat shrink ratios may be used as long as envelope 28 shrinks sufficiently to lie substantially adjacent cover 11 over its entire surface area.

Once binder cover 11, encased within envelope 28, is removed from the heat seal machine, a ring binder unit 24 can then be attached along the interior of spine 20, for example, by rivets 26 or other fasteners. Ring binder unit 24 may be attached by various means since the material of envelope 28 can be pierced by screws, clips or other elongated members without destroying the protective function of the envelope. The practice of the invention is not limited to ring binder units having a set of rings but may also include binders that use separable elongated members, sliding rings to secure flexible metal strips or other known page binding structures. After ring binder unit 24 is attached, notebook cover 11 is folded along edges 16 and 18 to close notebook cover 11 about ring unit 24. If notebook 10 is to be displayed with pages therein, ring binder unit 24 may be opened and pages inserted on rings 36. The notebook is now ready for shipment to retail outlets where the buying public can view binder cover 11 through transparent envelope 28 while the cover is still protected from any dirt or oils from the hands of the public. Envelope 28 does not interfere with the opening and inspecting of the notebook interior. The purchaser, at his option, can remove the envelope by inserting a penknife blade or the like into one of the holes 32 to tear envelope 28 so it may be removed from notebook cover 11; or it can be left on indefinitely.

While the protective envelope and method for applying the envelope herein described constitute a preferred embodiment of this invention, it is to be understood that the invention is not limited to this precise form of apparatus and that changes may be made therein without departing from the scope of the invention. Therefore, I do not intend to be limited except by the scope of the following appended claims.

What is claimed is:

1. A looseleaf binder having a removable protective envelope, said looseleaf binder comprising:

a spine;

a front cover flap and a rear cover flap, each of said cover flaps being hingedly connected to said spine;

a manually tearable protective envelope overlying substantially the entirety of each of said cover flaps as well as at least a portion of said spine, said envelope being readily removable from at least said flaps, without damaging either said flaps or said spine, upon tearing of said envelope; and a page binding structure fastened to said spine, said page binding structure overlying at least a portion of both said envelope and said spine;

whereby, said front and back cover flaps may be freely pivoted with respect to said spine in order to open and close said looseleaf binder so as to permit substantially complete inspection and use of same at point of sale and elsewhere without necessity of removing said protective envelope.

2. The looseleaf binder of claim 1 wherein said envelope is of a substantially transparent material.

3. The looseleaf binder of claim 1 wherein said envelope is formed of a heat shrinkable film.

4. The looseleaf binder of claim 3 wherein said film, prior to heat shrinking, has a shrink ratio of up to approximately 30%.

5. The looseleaf binder of claim 1 wherein said envelope has at least one perforation to facilitate the removal of said envelope from said front and back flaps and said spine.

6. The looseleaf binder of claim 1 further including pages for mounting photographs thereon, said ring binder unit being openable to remove said pages without damaging said envelope.

7. A looseleaf binder having a removable protective envelope, said looseleaf binder comprising:

a front cover flap and a back cover flap, each of said flaps having a respective inside and outside surface and peripheral edges bounding same;

a spine hingedly connected to each of said flaps, said spine having an outer surface adjoining said outside surfaces of said flaps and an inner surface adjoining said inside surfaces of said flaps;

a manually tearable protective envelope overlying substantially the entirety of said inside and outside surfaces of said flaps as well as at least said outer surface of said spine, said envelope covering at least said inside and outside surfaces of said flaps while being readily removable therefrom without damaging said flaps, by tearing said envelope;

a page binding structure overlying at least a portion of said inner surface of said spine as well as any portion of said envelope which overlies said portion of said inner surface of said spine; and fastening means fastening said page binding structure to said spine;

whereby, said front and back cover flaps may be freely pivoted with respect to said spine in order to open and close said looseleaf binder so as to permit substantially complete inspection thereof as well as operation of said page binding structure thereof without necessity of removing said protective envelope.

8. The looseleaf binder of claim 7 wherein said envelope is sealed to itself adjacent at least some of said peripheral edges of said front and back flaps.

9. The looseleaf binder of claim 7 wherein said envelope comprises a single sheet of film which is folded and secured to itself along at least some of the peripheral edges of said front and back flaps.

10. A method of making a looseleaf binder having a removable protective envelope, said method comprising the steps of:

providing a front cover flap and a mutually opposable rear cover flap, each of said flaps being hingedly connected to a common spine;

enveloping substantially the entirety of said flaps and spine in a manually tearable protective envelope, said envelope being readily removable from at least said flaps without damaging them, upon tearing of said envelope after said enveloping has been carried out, then fastening a page binding unit to said spine with said page binding unit overlying at least a portion of both said envelope and said spine.

11. The method of claim 10 wherein said envelope is formed of a heat shrinkable film, said method further including the step of heating said film to shrink it tightly around at least said flaps.

12. The method of claim 11 wherein said heat shrinkable film has a shrink ratio of up to approximately 30%.

13. The method of claim 10 wherein said envelope comprises a transparent film.

* * * * *